US010161350B2

(12) United States Patent
Kitazume et al.

(10) Patent No.: US 10,161,350 B2
(45) Date of Patent: Dec. 25, 2018

(54) INTERNAL-COMBUSTION ENGINE

(71) Applicant: TOYOTA JIDOSHA KABUSHIKI KAISHA, Toyota-shi, Aichi-ken (JP)

(72) Inventors: Yoshiyuki Kitazume, Hadano (JP); Norifumi Takada, Mishima (JP); Teruaki Haibara, Kanagawa-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/708,655

(22) Filed: Sep. 19, 2017

(65) Prior Publication Data

US 2018/0135553 A1 May 17, 2018

(30) Foreign Application Priority Data

Nov. 16, 2016 (JP) ..... 2016-223379

(51) Int. Cl.

| | |
|---|---|
| ***F02D 41/40*** | (2006.01) |
| ***F02D 41/14*** | (2006.01) |
| ***F02M 65/00*** | (2006.01) |
| ***F02D 41/30*** | (2006.01) |
| *F02D 41/38* | (2006.01) |
| *F02M 53/06* | (2006.01) |
| *F02M 69/04* | (2006.01) |

(52) U.S. Cl.

CPC ..... *F02D 41/402* (2013.01); *F02D 41/14* (2013.01); *F02D 41/3094* (2013.01); *F02M 65/008* (2013.01); *F02D 41/3836* (2013.01); *F02D 2041/389* (2013.01); *F02D 2200/0602* (2013.01); *F02M 53/06* (2013.01); *F02M 69/046* (2013.01)

(58) Field of Classification Search

CPC ..... F02D 41/40; F02D 41/402; F02D 41/14; F02D 41/3094; F02D 41/3836; F02D 2041/389; F02D 2200/0602; F02M 65/008; F02M 53/06; F02M 69/046

See application file for complete search history.

(56) References Cited

U.S. PATENT DOCUMENTS

| | | | | |
|---|---|---|---|---|
| 8,657,214 | B2 * | 2/2014 | Matsumura | F02M 61/184 123/584 |
| 9,670,866 | B2 * | 6/2017 | Mashiki | F02D 41/0057 |
| 2014/0216414 | A1 | 8/2014 | Kawabe et al. | |

FOREIGN PATENT DOCUMENTS

| | | | |
|---|---|---|---|
| JP | 2010-024927 | A | 2/2010 |
| JP | 2012-062858 | A | 3/2012 |
| JP | 2013-108401 | A | 6/2013 |

* cited by examiner

*Primary Examiner* — Hieu T Vo

(74) *Attorney, Agent, or Firm* — Hunton Andrews Kurth LLP

(57) ABSTRACT

An internal-combustion engine includes: a direct fuel injector directly injecting fuel into a combustion chamber; and a control device. The control device performs: presumption processing that presumes, based on an operating condition of the internal-combustion engine, that a thermoplastic deposit is formed on an injection hole portion of the direct fuel injector; temperature control processing that increases a temperature of the injection hole portion when the thermoplastic deposit is presumed to be formed; and first removal processing that injects the fuel from the direct fuel injector after the temperature control processing.

9 Claims, 11 Drawing Sheets

INTERNAL-COMBUSTION ENGINE

CROSS-REFERENCE TO RELATED APPLICATION

The present application claims priority to Japanese Patent Application No. 2016-223379 filed on Nov. 16, 2016, which is incorporated herein by reference in its entirety.

BACKGROUND

Technical Field

The present invention relates to a technique for removing a deposit formed on an injection hole portion of a direct fuel injector of an internal-combustion engine.

Background Art

An internal-combustion engine provided with a direct fuel injector for directly injecting fuel into a combustion chamber is known. An injection hole portion at a tip of the direct fuel injector is exposed to combustion gas in the combustion chamber. As a result, a deposit resulting from the fuel remaining on the injection hole portion accumulates on the injection hole portion. The deposit causes reduction in a flow rate of fuel passing through the injection hole and change in a spray shape, which deteriorates emission characteristics. Therefore, it is important to remove the deposit formed on the injection hole portion. The followings are known as techniques related to removal of the deposit.

Patent Literature 1 (JP-2012-62858) discloses a direct fuel injector provided with a heating device. While an engine is stopped, the heating device is used to heat an injection hole portion of the direct fuel injector to be a temperature of 160 to 240 degrees centigrade. Due to this heating, the deposit accumulated on the injection hole portion is carbonized. In the carbonized deposit, an internal stress increases and thus cracks are likely to be formed. When the cracks are formed, adhesion strength of the deposit decreases. Therefore, the deposit is likely to fall away when the fuel is injected from the direct fuel injector after the engine is started.

Patent Literature 2 (JP-2010-24927) discloses an internal-combustion engine provided with both a direct fuel injector and a port fuel injector. In order to remove the deposit, control that increases an amount of fuel injection from the direct fuel injector while decreases an amount of fuel injection from the port fuel injector is performed.

Patent Literature 3 (JP-2013-108401) discloses an internal-combustion engine provided with both a direct fuel injector and a port fuel injector. In order to remove the deposit, control that increases a frequency of fuel injection from the direct fuel injector is performed.

LIST OF RELATED ART

Patent Literature 1: Japanese Laid-Open Patent Publication No. 2012-62858

Patent Literature 2: Japanese Laid-Open Patent Publication No. 2010-24927

Patent Literature 3: Japanese Laid-Open Patent Publication No. 2013-108401

SUMMARY

The inventors of this application focused on a fact that a type of the deposit includes not only a thermoset deposit but also a thermoplastic deposit. The method disclosed in Patent Literature 1 is for removing the thermoset deposit. The thermoplastic deposit is neither recognized in Patent Literature 2 nor Patent Literature 3. Since a property of the thermoplastic deposit is different from that of the thermoset deposit, it is desirable to develop an appropriate method for removing the thermoplastic deposit.

An object of the present invention is to provide a technique for removing a thermoplastic deposit formed on an injection hole portion of a direct fuel injector of an internal-combustion engine.

A first invention provides an internal-combustion engine.

The internal-combustion engine includes:

a direct fuel injector directly injecting fuel into a combustion chamber; and a control device.

The control device performs:

presumption processing that presumes, based on an operating condition of the internal-combustion engine, that a thermoplastic deposit is formed on an injection hole portion of the direct fuel injector;

temperature control processing that increases a temperature of the injection hole portion when the thermoplastic deposit is presumed to be formed; and first removal processing that injects the fuel from the direct fuel injector after the temperature control processing.

A second invention further has the following features in addition to the first invention.

During a normal operation of the internal-combustion engine, the control device performs normal fuel injection control to control fuel injection from the direct fuel injector.

In the first removal processing, the control device performs the normal fuel injection control.

A third invention further has the following features in addition to the first invention.

The internal-combustion engine further includes a port fuel injector injecting fuel into an intake port.

In the temperature control processing, the control device decreases an amount of fuel injection from the direct fuel injector while increases an amount of fuel injection from the port fuel injector.

A fourth invention further has the following features in addition to the third invention.

During a normal operation of the internal-combustion engine, the control device performs normal fuel injection control to control fuel injection from the direct fuel injector and the port fuel injector.

In the temperature control processing, the control device reduces the amount of fuel injection from the direct fuel injector below a value determined by the normal fuel injection control.

In the first removal processing, the control device performs the normal fuel injection control.

A fifth invention further has the following features in addition to the first invention.

The internal-combustion engine further includes a heater disposed to heat the injection hole portion.

In the temperature control processing, the control device activates the heater.

A sixth invention further has the following features in addition to the fifth invention.

During a normal operation of the internal-combustion engine, the control device performs normal fuel injection control to control fuel injection from the direct fuel injector.

In the temperature control processing and the first removal processing, the control device performs the normal fuel injection control.

A seventh invention further has the following features in addition to any one of the first to sixth inventions.

The presumption processing includes:

processing of detecting a low temperature condition where the temperature of the injection hole portion is equal to or lower than a threshold value reflecting an upper limit of a formation temperature of the thermoplastic deposit; and processing of presuming that the thermoplastic deposit is formed on the injection hole portion, when the low temperature condition occurs at a certain level or more.

An eighth invention further has the following features in addition to any one of the first to sixth inventions.

During a normal operation of the internal-combustion engine, the control device performs normal fuel injection control to control fuel injection from the direct fuel injector.

The normal fuel injection control includes feedback control that corrects an amount of fuel injection based on a difference between a target air-fuel ratio and an actual air-fuel ratio.

The presumption processing includes processing of presuming that the thermoplastic deposit is formed on the injection hole portion, when a correction amount of the amount of fuel injection in the feedback control exceeds an allowable value.

A ninth invention further has the following features in addition to any one of the first to seventh inventions.

The control device further performs second removal processing, when it is determined that the thermoplastic deposit is not removed by the first removal processing.

In the second removal processing, the control device makes a fuel injection pressure of the direct fuel injector higher than in the first removal processing.

The first invention achieves effective deposit removal that takes a property of the thermoplastic deposit into consideration. More specifically, the thermoplastic deposit has a property that it softens with increase in temperature. When the thermoplastic deposit is presumed to be formed on the injection hole portion of the direct fuel injector, the control device performs the temperature control processing that increases the temperature of the injection hole portion. Due to the increase in temperature of the injection hole portion, the thermoplastic deposit softens and thus its adhesion strength decreases. Therefore, it is possible to easily blow away the softened thermoplastic deposit by injecting the fuel from the direct fuel injector. There is no need to unnecessarily increase a fuel injection pressure. Although the thermoplastic deposit is likely to be formed during a light load operation where the fuel injection pressure is low, it is possible to sufficiently blow away the thermoplastic deposit even in such the situation.

According to the second invention, the normal fuel injection control is performed in the first removal processing for removing the thermoplastic deposit. There is no need to forcibly increase the fuel injection pressure with departing from the normal fuel injection control.

According to the third invention, in the temperature control processing, the control device decreases the amount of fuel injection from the direct fuel injector. Since the injection amount of the fuel serving as a refrigerant is decreased, the temperature of the injection hole portion increases. There is no need to separately provide a heater for increasing the temperature, which is preferable in terms of reduction in costs and a size of the internal-combustion engine.

According to the fourth invention, the normal fuel injection control is performed in the first removal processing for removing the thermoplastic deposit. There is no need to forcibly increase the fuel injection pressure with departing from the normal fuel injection control.

According to the fifth invention, the thermoplastic deposit can be softened by the heating. Even in this case, it is possible to easily remove the thermoplastic deposit.

According to the sixth invention, there is no need to depart from the normal fuel injection control during the temperature control processing. In this case, complicated control becomes unnecessary.

According to the seventh invention, a property that the formation temperature of the thermoplastic deposit is low is considered in the presumption processing. More specifically, the control device detects the low temperature condition. When the low temperature condition occurs at a certain level or more, the control device presumes that the thermoplastic deposit is formed. By using the method focusing on the formation temperature, it is possible to presume the formation of the thermoplastic deposit with high accuracy.

According to the eighth invention, the presumption processing is performed by monitoring the correction amount of the amount of fuel injection in the feedback control. Such the presumption processing is simple.

According to the ninth invention, it is possible to remove a thermoset deposit.

EMBODIMENTS

Embodiments of the present invention will be described below with reference to the attached drawings.

1. Configuration of Internal-Combustion Engine

Figure 1:
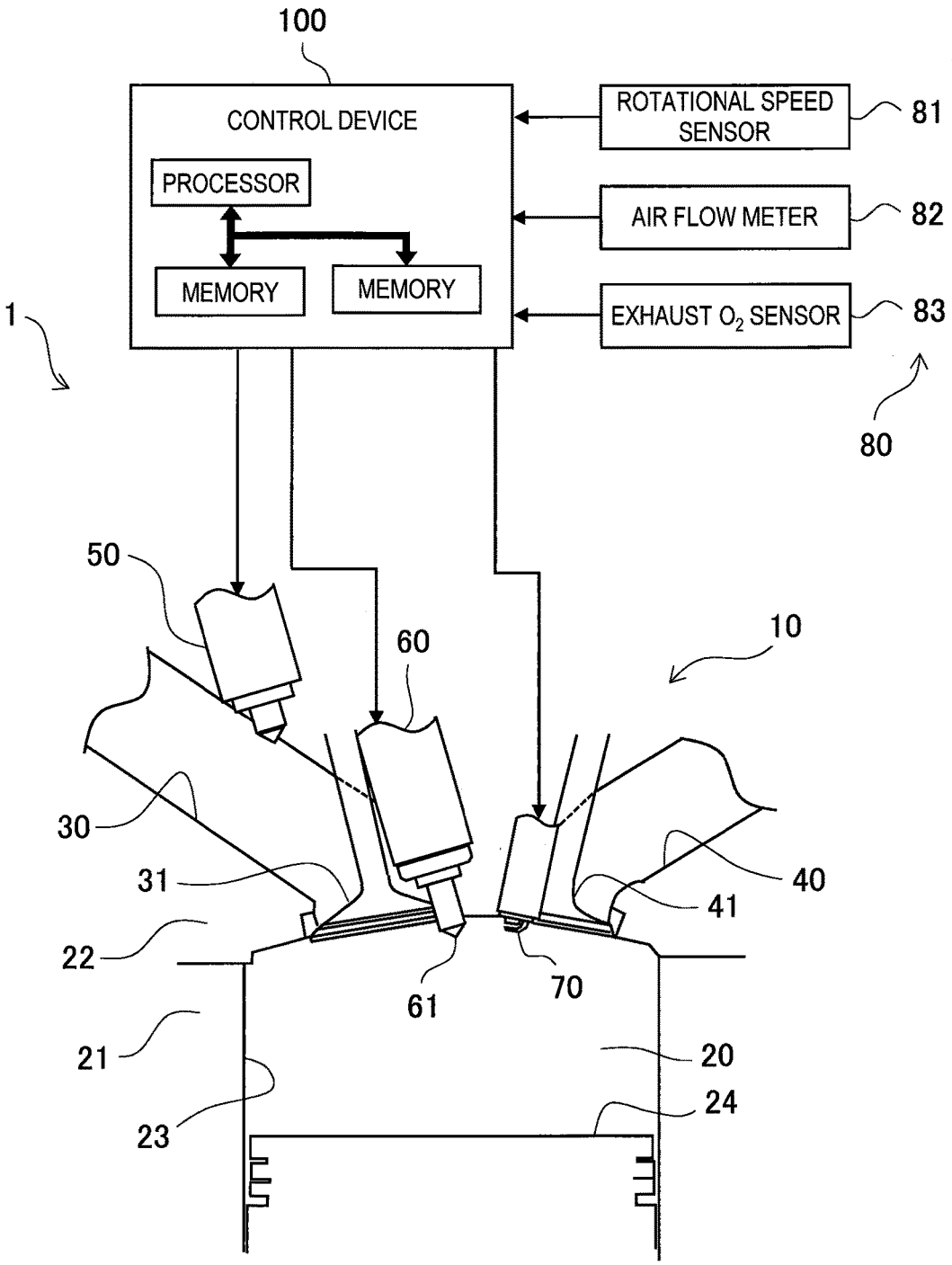
FIG. 1 is a schematic diagram showing a configuration example of an internal-combustion engine according to an embodiment of the present invention.

FIG. 1 is a schematic diagram showing a configuration example of an internal-combustion engine 1 according to an embodiment of the present invention. The internal-combustion engine 1 is provided with an engine main unit 10 and a control device 100. The engine main unit 10 includes a combustion chamber 20, an intake port 30, an exhaust port 40, a port fuel injector 50, a direct fuel injector 60, a spark plug 70, and a sensor group 80.

More specifically, the engine main unit 10 includes a cylinder block 21 and a cylinder head 22 placed on the cylinder block 21. The cylinder block 21 includes a cylinder 23 that forms a side wall of the combustion chamber 20. In the cylinder 23, a piston 24 is provided so as to reciprocate in an axis direction of the cylinder 23. The combustion chamber 20 is a space surrounded by the cylinder head 22, the cylinder 23, and the piston 24.

The intake port 30 and the exhaust port 40 are formed within the cylinder head 22 and connected to the combustion chamber 20. An intake valve 31 is provided at an opening of the intake port 30 to the combustion chamber 20. An exhaust valve 41 is provided at an opening of the exhaust port 40 to the combustion chamber 20. The intake valve 31 and the exhaust valve 41 are driven by a variable valve actuation mechanism not shown.

The port fuel injector 50, which is a fuel injector for injecting fuel into the intake port 30, is provided at the intake port 30. On the other hand, the direct fuel injector 60 is a fuel injector for directly injecting fuel into the combustion chamber 20. In the example shown in FIG. 1, the direct fuel injector 60 is provided at a ceiling portion of the combustion chamber 20 so as to be close to the spark plug 70.

The sensor group 80 is provided for detecting an operating condition of the internal-combustion engine 1. For example, the sensor group 80 includes a rotational speed sensor 81, an air flow meter 82, and an exhaust $O_2$ sensor 83. The rotational speed sensor 81 detects an engine rotational speed. The air flow meter 82 detects an intake air flow rate (a fresh air flow rate). The exhaust $O_2$ sensor 83 detects an oxygen concentration in exhaust gas.

The control device 100 controls an operation of the internal-combustion engine 1. Typically, the control device 100 is a microcomputer provided with a processor, a memory, and an input-output interface. The control device 100 is also called an ECU (Electronic Control Unit). The control device 100 receives the detected information from the sensor group 80 and outputs control signals to a variety of actuators through the input-output interface. The actuators include the port fuel injector 50, the direct fuel injector 60, and an ignition device including the spark plug 70, and further includes a throttle valve, the variable valve actuation mechanism, and so forth which are not shown.

In the present embodiment, we focus especially on control of the port fuel injector 50 and the direct fuel injector 60 by the control device 100. The control device 100 recognizes an operating condition of the internal-combustion engine 1 based on the detected information received from the sensor group 80, and performs "fuel injection control" based on the operating condition. More specifically, based on the operating condition, the control device 100 calculates control parameters such as a total amount of fuel injection, amounts of fuel injection from the port fuel injector 50 and the direct fuel injector 60, fuel pressure (fuel injection pressure), and an injection timing. Then, the control device 100 controls the fuel injection from each of the port fuel injector 50 and the direct fuel injector 60 according to the calculated control parameters.

Furthermore, the control device 100 according to the present embodiment performs "deposit removal processing" that removes a deposit adhering to the direct fuel injector 60. As shown in FIG. 1, an injection hole portion 61 at a tip of the direct fuel injector 60 is exposed to the combustion chamber 20. Here, the injection hole portion 61 includes not only an injection hole for injecting the fuel but also its peripheral portion. Since the injection hole portion 61 is exposed to combustion gas in the combustion chamber 20, a deposit resulting from the fuel remaining on the injection hole portion 61 accumulates on the injection hole portion 61. The deposit causes reduction in a flow rate of fuel passing through the injection hole and change in a spray shape, which deteriorates emission characteristics. It is therefore important to remove the deposit formed on the injection hole portion 61.

2. Thermoplastic Deposit

The inventors of this application focused on a fact that a type of the deposit includes not only a thermoset deposit but also a thermoplastic deposit. The thermoplastic deposit softens with increase in temperature and eventually melts. Moreover, the thermoplastic deposit hardens again when it is cooled. On the other hand, the thermoset deposit does not become so soft and maintains some degree of hardness even when its temperature increases.

Figure 2:
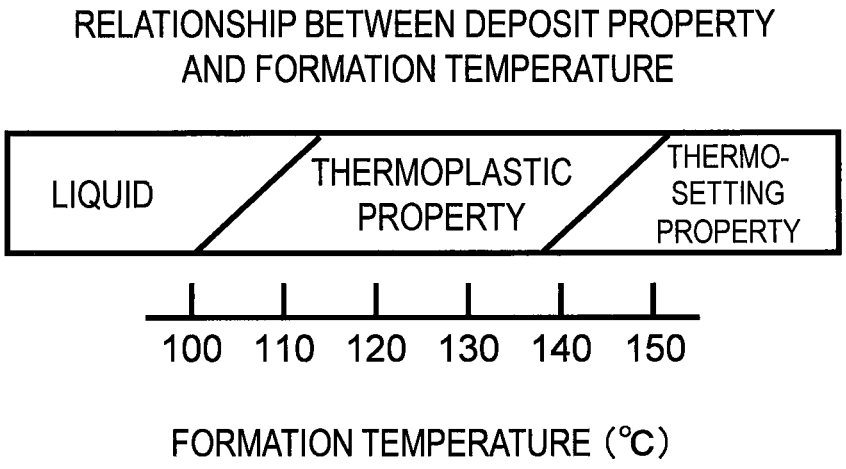
FIG. 2 is a conceptual diagram showing a relationship between a deposit property and a formation temperature.

A property of the deposit depends on a formation temperature of the deposit. FIG. 2 shows a relationship between the deposit property and the formation temperature. When the formation temperature is relatively low of about 110 to 135 degrees centigrade, the formed deposit becomes the thermoplastic deposit. When the formation temperature becomes higher than about 140 degrees centigrade, the formed deposit exhibits a thermosetting property.

The inventors of this application focused particularly on the "thermoplastic deposit" that is formed at the relatively low temperature, among the deposits. For example, when a vehicle is caught in a traffic jam, the internal-combustion engine 1 is operated with a light load for a long time. During such the light load operation, temperature of the injection hole portion 61 of the direct fuel injector 60 is relatively low. Therefore, there is a high possibility that the thermoplastic deposit is formed on the injection hole portion 61.

In general, force of fuel injection is utilized for removing a deposit formed on the injection hole portion 61. For example, it is common to blow away the deposit by increasing fuel pressure of the direct fuel injector 60. However, during the light load operation where the thermoplastic deposit is likely to be formed, the amount of fuel injection is small and thus it is hard to increase the fuel pressure because of qmin restriction and machine limitation. In order to increase the fuel pressure, it is necessary to increase the amount of fuel injection, and for that purpose, it is necessary to forcibly increase engine load. However, to forcibly increase the engine load causes deterioration of a fuel economy and emission characteristics. Besides, it can be considered to increase the amount of fuel injection from the direct fuel injector 60 by decreasing the amount of fuel injection from the port fuel injector 50. However, when the amount of fuel injection from the port fuel injector 50 decreases, homogeneity of combustion deteriorates, which eventually causes deterioration of the fuel economy and the emission characteristics.

As described above, during the light load operation, the thermoplastic deposit is likely to be formed, while it is difficult or not preferable to increase the fuel pressure for removing the thermoplastic deposit.

In view of the above, the present invention proposes a new method suitable for removing the thermoplastic deposit. The new method utilizes the specific property of the thermoplastic deposit. More specifically, the new method according to the present invention softens or melts the thermoplastic deposit by moderately increasing temperature of the thermoplastic deposit. Due to this, adhesion strength of the thermoplastic deposit decreases. As a result, it is possible to sufficiently blow away the thermoplastic deposit even at the low fuel pressure during the light load operation. The inventors of this application have confirmed effectiveness of the new method through experiments.

Hereinafter, concrete configuration and processing for achieving the new method according to the present invention will be described.

3. First Embodiment

Figure 3:
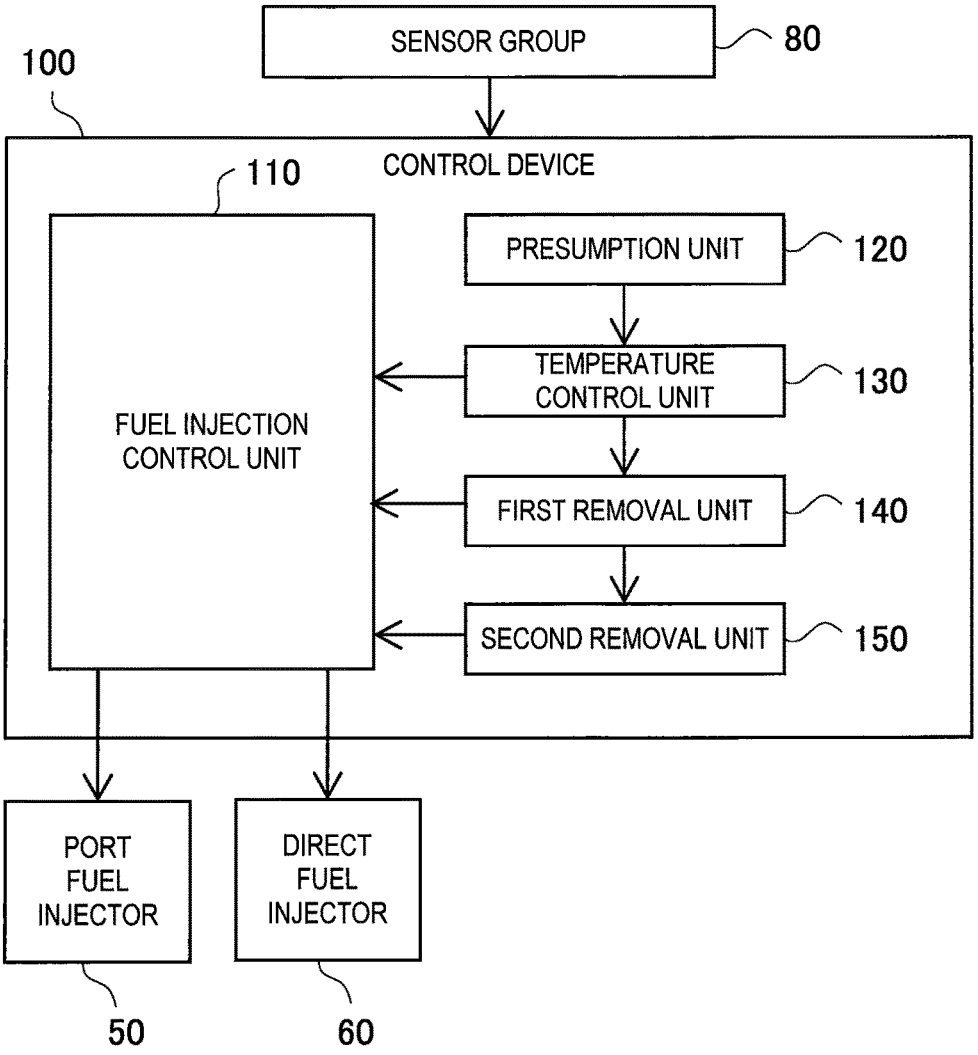
FIG. 3 is a block diagram showing a functional configuration of a control device according to a first embodiment of the present invention.

FIG. 3 is a block diagram showing a functional configuration of the control device 100 according to a first embodiment of the present invention. The control device 100 includes, as functional blocks, a fuel injection control unit 110, a presumption unit 120, a temperature control unit 130, a first removal unit 140, and a second removal unit 150 These functional blocks are achieved by the processor of the control device 100 executing a control program stored in the memory. The control program may be recorded on a computer-readable recording medium.

Figure 4:
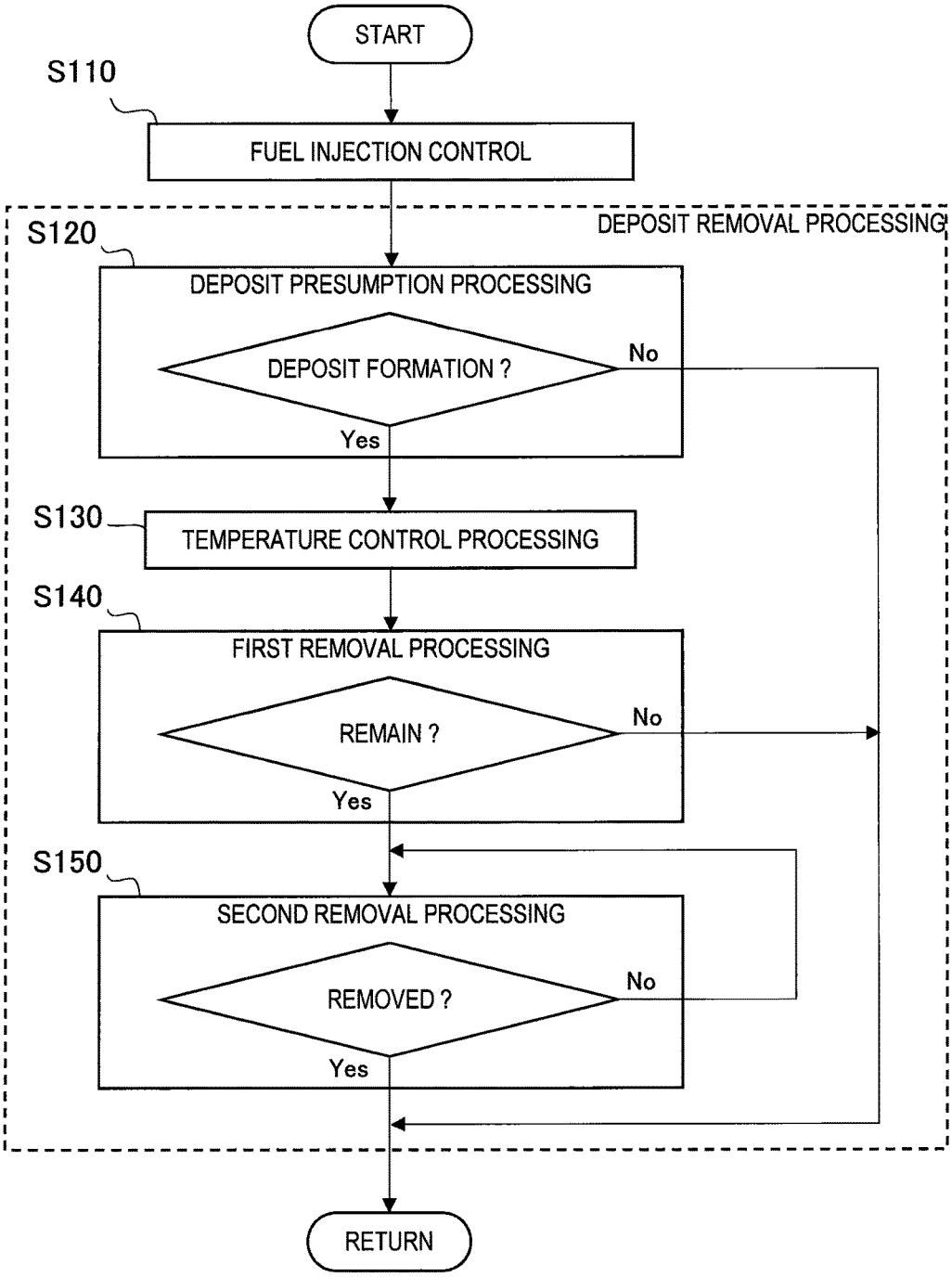
FIG. 4 is a flow chart showing processing by the control device according to the first embodiment.

FIG. 4 is a flow chart showing processing by the control device 100 according to the first embodiment. The processing flow shown in FIG. 4 is executed repeatedly. Hereinafter, each process will be described in detail.

3-1. Step S110 (Fuel Injection Control)

The fuel injection control unit 110 controls fuel injection from each of the port fuel injector 50 and the direct fuel injector 60. More specifically, the fuel injection control unit 110 recognizes the operating condition of the internal-combustion engine 1 based on the detected information received from the sensor group 80. Then, based on the operating condition of the internal-combustion engine 1, the fuel injection control unit 110 calculates control parameters used for the fuel injection control. The control parameters include a total amount of fuel injection, the amounts of fuel injection from the port fuel injector 50 and the direct fuel injector 60, the fuel pressure, the injection timing, and so forth.

An example of a method of calculating the total amount of fuel injection is as follows. The rotational speed sensor 81 detects the engine rotational speed, the air flow meter 82 detects the intake air flow rate, and the exhaust $O_2$ sensor 83 detects the exhaust oxygen concentration, as described above. Based on the operating condition such as the engine rotational speed and the intake air flow rate, the fuel injection control unit 110 calculates a base amount of fuel injection for realizing a target air-fuel ratio. Meanwhile, the fuel injection control unit 110 detects an actual air-fuel ratio based on the exhaust oxygen concentration. Based on a difference between the target air-fuel ratio and the actual air-fuel ratio, the fuel injection control unit 110 corrects the base amount of fuel injection to calculate the total amount of fuel injection. That is to say, the fuel injection control unit 110 performs feedback control of the total amount of fuel injection (i.e. the air-fuel ratio) based on the difference between the target air-fuel ratio and the actual air-fuel ratio.

Calculating the amounts of fuel injection from the port fuel injector 50 and the direct fuel injector 60 is equivalent to calculating a distribution ratio (allocation ratio) of the total amount of fuel injection. For example, the distribution ratio is calculated by reference to a ratio map that is created in advance. An input parameter for the ratio map is exemplified by the engine rotational speed, the engine load (i.e. the intake air flow rate), and so forth. The fuel injection control unit 110 calculates the distribution ratio based on the input parameter and the ratio map.

The fuel pressure is calculated by reference to a fuel pressure map that is created in advance. An input parameter for the fuel pressure map is exemplified by the engine rotational speed, the engine load, and so forth. The fuel injection control unit 110 calculates the fuel pressure based on the input parameter and the fuel pressure map. In general, the larger the engine load is, the higher the fuel pressure obtained from the fuel pressure map becomes. Conversely, the smaller the engine load is, the lower the fuel pressure obtained from the fuel pressure map becomes. Thus, during the light load operation where the thermoplastic deposit is likely to be formed, the fuel pressure obtained from the fuel pressure map is low.

During a normal operation of the internal-combustion engine 1, the fuel injection control unit 110 performs the fuel injection control as described above with respect to the port fuel injector 50 and the direct fuel injector 60. The fuel injection control during the normal operation is hereinafter referred to as "normal fuel injection control". According to the present embodiment, "deposit removal processing" as described below is performed as special processing during the normal fuel injection control. In the deposit removal processing, the control parameters calculated by the normal fuel injection control are corrected as necessary.

3-2. Step S120 (Deposit Presumption Processing)

In the deposit removal processing, the presumption unit 120 first performs deposit presumption processing. More specifically, based on the operating condition of the internal-combustion engine 1, the presumption unit 120 presumes that the thermoplastic deposit is formed on the injection hole portion 61 of the direct fuel injector 60. If it is determined that no thermoplastic deposit is formed (Step S120; No), then the deposit removal processing ends. On the other hand, if the thermoplastic deposit is presumed to be formed (Step S120; Yes), then the processing proceeds to Step S130.

As shown in FIG. 2, the formation temperature of the thermoplastic deposit is low. Therefore, detecting a "low temperature condition" where the temperature of the injection hole portion 61 of the direct fuel injector 60 is equal to or lower than a threshold value X can be considered as a method for presuming that the thermoplastic deposit is formed. Here, the threshold value X is set based on an upper limit of the formation temperature of the thermoplastic deposit. In other words, the upper limit of the formation temperature of the thermoplastic deposit is reflected in the threshold value X. For example, the threshold value X is set to 130 degrees centigrade (see FIG. 2). When the low temperature condition occurs at a certain level or more, the presumption unit 120 presumes that the thermoplastic deposit is formed on the injection hole portion 61.

Figure 5:
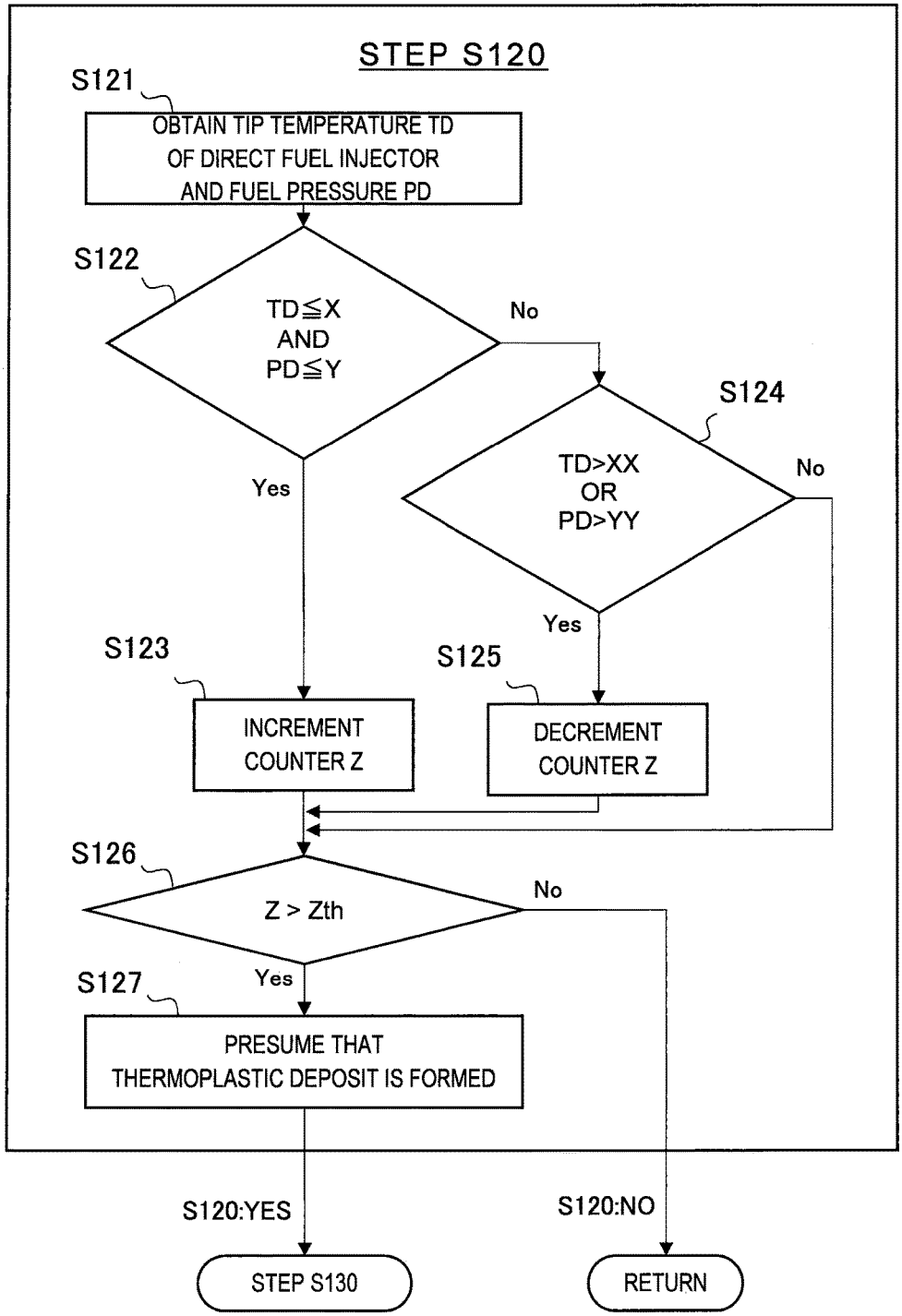
FIG. 5 is a flow chart showing an example of deposit presumption processing in the first embodiment.

FIG. 5 is a flow chart showing an example of the deposit presumption processing based on the above-mentioned concept. In this example, a counter Z is used as a parameter indicating a degree of formation of the thermoplastic deposit. An initial value of the counter Z is 0.

Step S121:

The presumption unit 120 obtains a tip temperature TD of the direct fuel injector 60 and a fuel pressure PD (Step S121). The tip temperature TD, which is the temperature of the injection hole portion 61, is calculated (estimated) by reference to a temperature map that is created in advance. An input parameter for the temperature map is exemplified by the engine load, the above-described distribution ratio (i.e. the ratio of the amounts of fuel injection from the port fuel injector 50 and the direct fuel injector 60), and so forth. The presumption unit 120 calculates the tip temperature TD based on the input parameter and the temperature map. Moreover, the presumption unit 120 obtains the fuel pressure PD determined by the normal fuel injection control.

Steps S122 and S123:

The presumption unit 120 determines whether a formation condition where the thermoplastic deposit is likely to be formed is satisfied or not (Step S122). The formation condition is that both of the following first condition and second condition are satisfied.

[First condition] the tip temperature TD being equal to or lower than the threshold value X (TD≤X)

[Second condition] the fuel pressure PD being equal to or lower than a threshold value Y (PD≤Y)

The first condition is a condition for detecting the low temperature condition where the thermoplastic deposit is likely to be formed. As described above, the threshold value X is set based on the upper limit of the temperature at which the thermoplastic deposit is formed. For example, the threshold value X is set to 130 degrees centigrade.

The second condition is a condition for detecting a low fuel pressure condition where the thermoplastic deposit is unlikely to fall away. The threshold value Y is set based on an upper limit of the fuel pressure that cannot fall away the deposit. For example, the threshold value Y is set to 10 Mpa. It should be noted that at the time of the light load operation where the tip temperature TD is low, the fuel pressure obtained from the fuel pressure map also is low. Therefore, when the first condition is satisfied, the second condition also is likely to be satisfied. From this point of view, it is also possible to use only the above-mentioned first condition (i.e. detection of the low temperature condition) as the formation condition.

If the formation condition is satisfied (Step S122; Yes), then the presumption unit 120 increments the counter Z (Step S123). After that, the processing proceeds to Step S126. On the other hand, if the formation condition is not satisfied (Step S122; No), the processing proceeds to Step S124.

Steps S124 and S125:

The presumption unit 120 determines whether a fall-away condition where the thermoplastic deposit is likely to fall away is satisfied or not (Step S124). The fall-away condition is that either the following third condition or fourth condition is satisfied.

[Third condition] the tip temperature TD being higher than a threshold value XX (TD>XX)

[Fourth condition] the fuel pressure PD being higher than a threshold value YY (PD>YY)

The third condition is a condition for detecting a softening condition where the thermoplastic deposit sufficiently softens. The threshold value XX is set based on a temperature at which the thermoplastic deposit sufficiently softens. For example, the threshold value XX is set to 130 degrees centigrade. When the tip temperature TD (i.e. the temperature of the injection hole portion 61) becomes higher than the threshold value XX, the thermoplastic deposit softens and thus is likely to fall away by the fuel injection.

The fourth condition is a condition for detecting a high fuel pressure condition where the thermoplastic deposit is likely to fall away. The threshold value YY is set based on a lower limit of the fuel pressure that can fall away the deposit. For example, the threshold value YY is set to 10 Mpa.

If the fall-away condition is satisfied (Step S124; Yes), then the presumption unit 120 decrements the counter Z (Step S125). After that, the processing proceeds to Step S126. On the other hand, if the fall-away condition is not satisfied (Step S124; No), then the processing proceeds to Step S126 without through Step S125.

Steps S126 and S127:

The presumption unit 120 compares the counter Z with a threshold value Zth (Step S126). The threshold value Zth is an upper limit of an allowable range of the degree of formation of the thermoplastic deposit. If the counter Z exceeds the threshold value Zth (Step S126; Yes), then the presumption unit 120 presumes that a non-negligible amount of the thermoplastic deposit has been formed (Step S127). That is, the determination at Step S120 results in "Yes", and the processing proceeds to the subsequent Step S130. On the other hand, when the counter Z is equal to or less than the threshold value Zth (Step S126; No), the determination at Step S120 results in "No".

3-3. Step S130 (Temperature Control Processing)

The temperature control unit 130 performs temperature control processing that increases the temperature of the injection hole portion 61 of the direct fuel injector 60. As the temperature of the injection hole portion 61 increases, the temperature of the thermoplastic deposit formed on the injection hole portion 61 also increases. As a result, it is expected that the thermoplastic deposit softens.

In the present embodiment, the temperature control unit 130 increases the temperature of the injection hole portion 61 by decreasing the amount of fuel injection from the direct fuel injector 60. The fuel passing through the injection hole of the direct fuel injector 60 also serves as a refrigerant that cools the injection hole portion 61. Therefore, decrease in the amount of fuel injection from the direct fuel injector 60 results in increase in the temperature of the injection hole portion 61.

More specifically, the temperature control unit 130 instructs the fuel injection control unit 110 to change the distribution ratio of the total amount of fuel injection. In accordance with the instruction from the temperature control unit 130, the fuel injection control unit 110 departs from the normal fuel injection control to change the distribution ratio. More specifically, the fuel injection control unit 110 reduces the amount of fuel injection from the direct fuel injector 60 below a value determined by the normal fuel injection control. On the other hand, the fuel injection control unit 110 increases the amount of fuel injection from the port fuel injector 50 above a value determined by the normal fuel injection control. The total amount of fuel injection does not change.

In this manner, the temperature control unit 130 according to the present embodiment performs the temperature control processing that decreases the amount of fuel injection from the direct fuel injector 60 while increases the amount of fuel injection from the port fuel injector 50. As a result, the temperature of the injection hole portion 61 increases, and thus the temperature of the thermoplastic deposit formed on the injection hole portion 61 also increases. There is no need to separately provide a heater for increasing the temperature, which is preferable in terms of reduction in costs and a size of the internal-combustion engine 1.

The temperature control unit 130 may set the amount of fuel injection from the direct fuel injector 60 to zero. In this case, during the temperature control processing, the direct injection (DI: Direct Injection) completely stops and only the port injection (PFI: Port Fuel Injection) is performed. In the case where the amount of fuel injection from the direct fuel injector 60 is zero, the temperature of the injection hole portion 61 rises quickly and effectively.

It should be noted that in the temperature control processing according to the present embodiment, there is no need to unnecessarily increase the temperature of the injection hole portion 61. A temperature at which the thermoplastic deposit softens is enough. For example, the thermoplastic deposit sufficiently softens at a temperature of about 130 degrees centigrade. Therefore, the temperature control processing is performed such that a target temperature of 130 degrees centigrade for example is obtained. The target temperature is obviously lower than a temperature (i.e. 160 to 240 degrees centigrade) for carbonizing a thermoset deposit as disclosed in Patent Literature 1 (JP-2012-62858).

The temperature control unit 130 performs the temperature control processing for a certain period of time, for example. The certain period of time is set to a length with which the target temperature (for example, 130 degrees centigrade) can be obtained. Alternatively, the temperature control unit 130 may monitor the tip temperature TD calculated from the temperature map mentioned above to perform the temperature control processing such that the tip temperature TD becomes the target temperature.

3-4. Step S140 (First Removal Processing)

Due to the temperature control processing described above, it is expected that the thermoplastic deposit on the injection hole portion 61 softens and thus its adhesion strength decreases. Therefore, it is considered that it is possible to easily blow away the softened thermoplastic deposit by injecting the fuel from the direct fuel injector 60.

In view of the above, the first removal unit 140 performs first removal processing that injects the fuel from the direct fuel injector 60 after the temperature increase. More specifically, the first removal unit 140 instructs the fuel injection control unit 110 to increase the amount of fuel injection from the direct fuel injector 60 which has been decreased in the temperature control processing. Typically, the first removal unit 140 instructs the fuel injection control unit 110 to perform the normal fuel injection control. In accordance with the instruction from the first removal unit 140, the fuel injection control unit 110 injects the fuel from the direct fuel injector 60. Here, since the thermoplastic deposit is softened, there is no need to unnecessarily increase the fuel pressure. It is possible to sufficiently blow away the thermoplastic deposit even at the low fuel pressure (for example, 4 MPa) during the light load operation.

Whether the deposit on the injection hole portion 61 is removed or not can be determined by monitoring the above-described feedback control of the total amount of fuel injection (i.e. the air-fuel ratio). When the deposit accumulates on the injection hole portion 61 of the direct fuel injector 60, an intended amount of fuel is not be injected from the direct fuel injector 60. That is, discrepancy occurs between the amount of fuel injection calculated by the fuel injection control unit 110 and an actual amount of fuel injection. The discrepancy acts to increase the difference between the target air-fuel ratio and the actual air-fuel ratio, namely a correction amount of the amount of fuel injection in the feedback control. As the deposit increases, the correction amount in the feedback control (hereinafter referred to as a "feedback correction amount") becomes larger.

Figure 6:
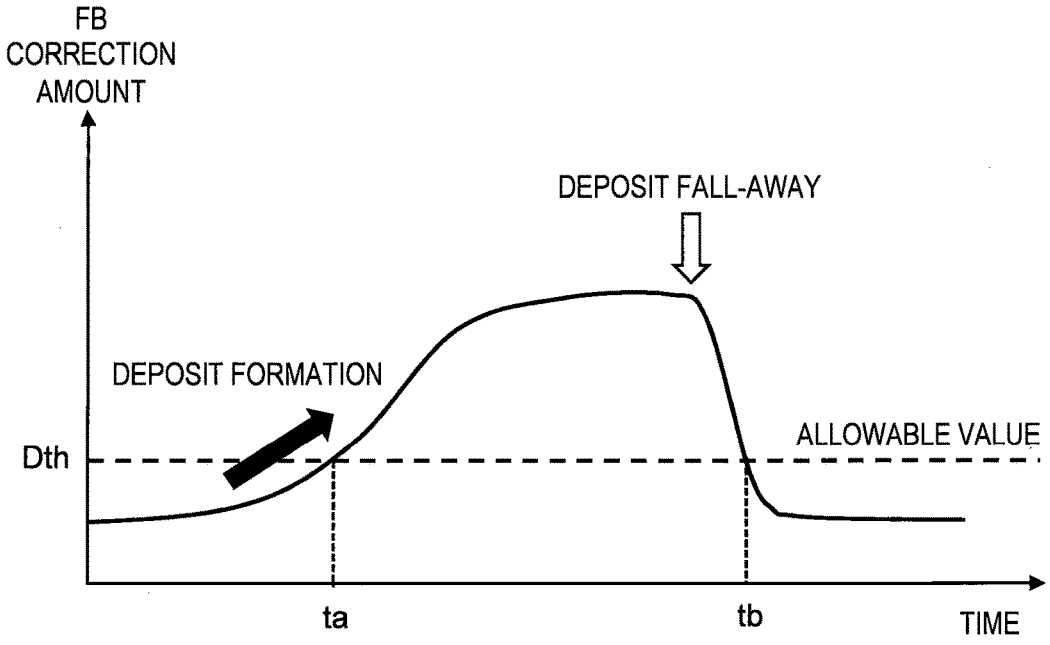
FIG. 6 is a timing chart showing a relationship between a feedback correction amount and a deposit state.

FIG. 6 is a timing chart showing a relationship between the feedback correction amount and a deposit state. A vertical axis represents the feedback correction amount. As the amount of deposit formed on the injection hole portion 61 increases, the feedback correction amount also increases accordingly. When the deposit on the injection hole portion 61 falls away, the feedback correction amount decreases. Therefore, by monitoring the feedback correction amount, it is possible to determine whether or not the deposit formed on the injection hole portion 61 is removed.

More specifically, after injecting the fuel from the direct fuel injector 60, the first removal unit 140 compares the feedback correction amount with an allowable value Dth. The allowable value Dth is determined based on an upper limit of an allowable amount of deposit (i.e. reduction in the flow rate of fuel). If the feedback correction amount becomes equal to or less than the allowable value Dth within a certain period of time after the fuel injection from the direct fuel injector 60, the first removal unit 140 determines that the thermoplastic deposit is removed (Step S140; No). In the example shown in FIG. 6, the first removal unit 140 determines at a time tb that the thermoplastic deposit is removed. In this case, the deposit removal processing ends.

On the other hand, if the feedback correction amount is still greater than the allowable value Dth even after the certain period of time after the fuel injection from the direct fuel injector 60, the first removal unit 140 determines that some kind of deposit remains on the injection hole portion 61 (Step S140; Yes). In this case, it is highly possible that the deposit formed on the injection hole portion 61 is not the thermoplastic deposit but a thermoset deposit formed in a high temperature condition. In this case, the processing further proceeds to Step S150.

3-5. Step S150 (Second Removal Processing)

The second removal unit 150 performs second removal processing for removing the thermoset deposit. More specifically, the second removal unit 150 instructs the fuel injection control unit 110 to increase the fuel pressure of the direct fuel injector 60 for a certain period of time. In accordance with the instruction from the second removal unit 150, the fuel injection control unit 110 makes the fuel pressure of the direct fuel injector 60 higher than in the first removal processing. For example, the fuel injection control unit 110 increases the fuel pressure to 10 Mpa or more.

After the increase in the fuel pressure, the second removal unit 150 compares the feedback correction amount with the allowable value Dth, as in the case of the first removal processing. If the feedback correction amount becomes equal to or less than the allowable value Dth within a certain period of time after the increase in the fuel pressure, the second removal unit 150 determines that the deposit formed on the injection hole portion 61 is removed (Step S150; Yes). In this case, the deposit removal processing ends.

On the other hand, if the feedback correction amount is still greater than the allowable value Dth even after the certain period of time after the increase in the fuel pressure, the second removal unit 150 determines that the deposit remains on the injection hole portion 61 (Step S150; No). In this case, the second removal unit 150 repeats Step S150. If Step S150 is repeated a predetermined number of times, the second removal unit 150 may determine that an event other than the deposit occurs and abandon the deposit removal processing.

3-6. One Example of Removal of Thermoplastic Deposit

Figure 7:
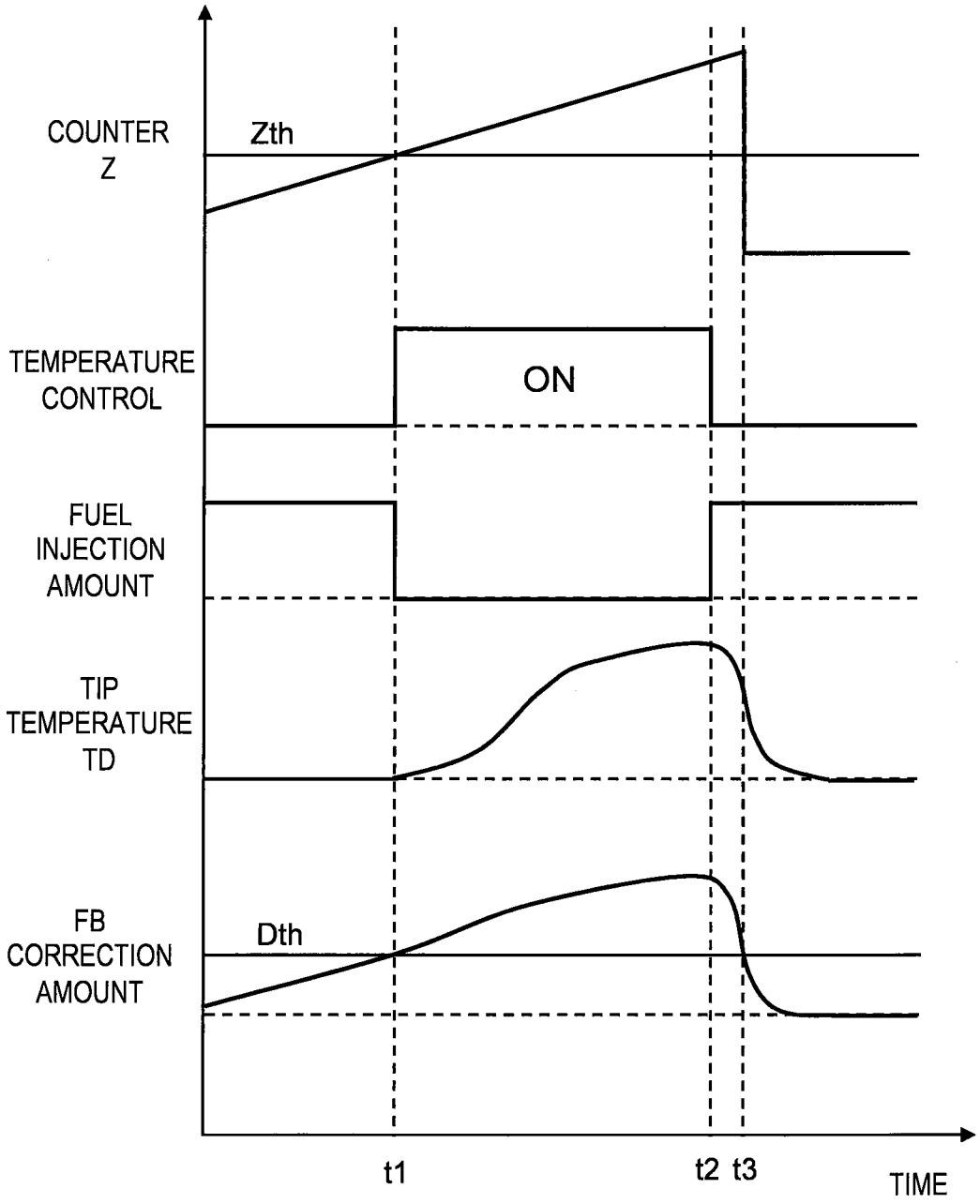
FIG. 7 is a timing chart showing an example of deposit removal processing in the first embodiment.

FIG. 7 is a timing chart showing an example of the deposit removal processing in the present embodiment. The internal-combustion engine 1 is performing the light load operation and the counter Z increases with time.

At a time t1, the counter Z exceeds the threshold value Zth (Step S126; Yes). The control device 100 presumes that the thermoplastic deposit is formed on the injection hole portion 61 (Step S120; Yes), and starts the temperature control processing (Step S130). More specifically, the control device 100 stops the fuel injection from the direct fuel injector 60.

As a result, the temperature of the injection hole portion 61 (i.e. the tip temperature TD) begins to increase.

At a time t2, the control device 100 terminates the temperature control processing and starts the first removal processing (Step S140). More specifically, the control device 100 resumes the fuel injection from the direct fuel injector 60.

At a time t3, the feedback correction amount becomes equal to or less than the allowable value Dth (Step S140; No). The control device 100 determines that the thermoplastic deposit is removed, and terminates the deposit removal processing. At this time, the control device 100 initializes the counter Z.

3-7. Effects

According to the present embodiment, an effective deposit removal considering the property of the thermoplastic deposit is achieved.

First, during the operation of the internal-combustion engine 1, the control device 100 presumes that the thermoplastic deposit is formed on the injection hole portion 61 of the direct fuel injector 60. In this presumption processing, the property that the formation temperature of the thermoplastic deposit is low is taken into consideration. More specifically, the control device 100 detects the low temperature condition. When the low temperature condition occurs at a certain level or more, the control device 100 presumes that the thermoplastic deposit is formed. By using the method focusing on the formation temperature, it is possible to presume the formation of the thermoplastic deposit with high accuracy.

Moreover, the thermoplastic deposit has the property that it softens and melts with increase in temperature. Considering this property, the control device 100 performs the temperature control processing that increases the temperature of the injection hole portion 61 of the direct fuel injector 60, in order to facilitate the removal of the thermoplastic deposit. More specifically, the control device 100 decreases the amount of fuel injection from the direct fuel injector 60. Since the injection amount of the fuel serving as a refrigerant is decreased, the temperature of the injection hole portion 61 increases. There is no need to separately provide a heater for increasing the temperature, which is preferable in terms of reduction in costs and a size of the internal-combustion engine 1.

It should be noted that in the temperature control processing according to the present embodiment, there is no need to unnecessarily increase the temperature of the injection hole portion 61. A temperature at which the thermoplastic deposit softens is enough. For example, the thermoplastic deposit sufficiently softens at a temperature of about 130 degrees centigrade. This temperature is obviously lower than a temperature (i.e. 160 to 240 degrees centigrade) for carbonizing a thermoset deposit as disclosed in Patent Literature 1 (JP-2012-62858).

Due to the temperature control processing, the thermoplastic deposit softens and thus its adhesion strength decreases. Therefore, it is possible to easily blow away the softened thermoplastic deposit by injecting the fuel from the direct fuel injector 60. Here, there is no need to unnecessarily increase the fuel pressure. For example, there is no need to forcibly increase the fuel pressure with departing from the normal fuel injection control. It is possible to sufficiently blow away the thermoplastic deposit even at the low fuel pressure (for example, 4 MPa) during the light load operation.

As a comparative example, let us consider a case where the fuel pressure is increased in order to remove the thermoplastic deposit. The thermoplastic deposit is likely to be formed during the light load operation. However, during such the light load operation, the amount of fuel injection is small and thus it is hard to increase the fuel pressure because of qmin restriction and machine limitation. In order to increase the fuel pressure, it is necessary to increase the amount of fuel injection, and for that purpose, it is necessary to forcibly increase the engine load. However, to forcibly increase the engine load causes deterioration of a fuel economy and emission characteristics. Besides, it can be considered to increase the amount of fuel injection from the direct fuel injector 60 by decreasing the amount of fuel injection from the port fuel injector 50. However, when the amount of fuel injection from the port fuel injector 50 decreases, homogeneity of combustion deteriorates, which eventually causes deterioration of the fuel economy and the emission characteristics.

According to the present embodiment, it is possible to remove the thermoplastic deposit even at the low fuel pressure. Therefore, the problems as in the case of the above-mentioned comparative example do not occur.

4. Second Embodiment

A second embodiment of the present invention is different from the first embodiment in the deposit presumption processing (Step S120). The others are the same as in the case of the first embodiment. An overlapping description will be omitted as appropriate.

In the deposit presumption processing according to the second embodiment, the control device 100 (i.e. the presumption unit 120) monitors the feedback correction amount as shown in FIG. 6 instead of the counter Z. If the feedback correction amount exceeds the allowable value Dth (at a time to in the example shown in FIG. 6), then the control device 100 presumes that the thermoplastic deposit is formed on the injection hole portion 61.

It should be noted that not only the thermoplastic deposit but also the thermoset deposit contributes to the increase in the feedback correction amount. In that sense, it can be said that the presumption accuracy in the second embodiment is lower than that in the first embodiment. Even though the presumption accuracy is low, it is enough to perform the subsequent Steps S130 to S150 in the same manner as in the case of the first embodiment. If the formed deposit is the thermoplastic deposit, it is removed by the first removal processing. If the formed deposit is the thermoset deposit, it is removed by the second removal processing.

Figure 8:
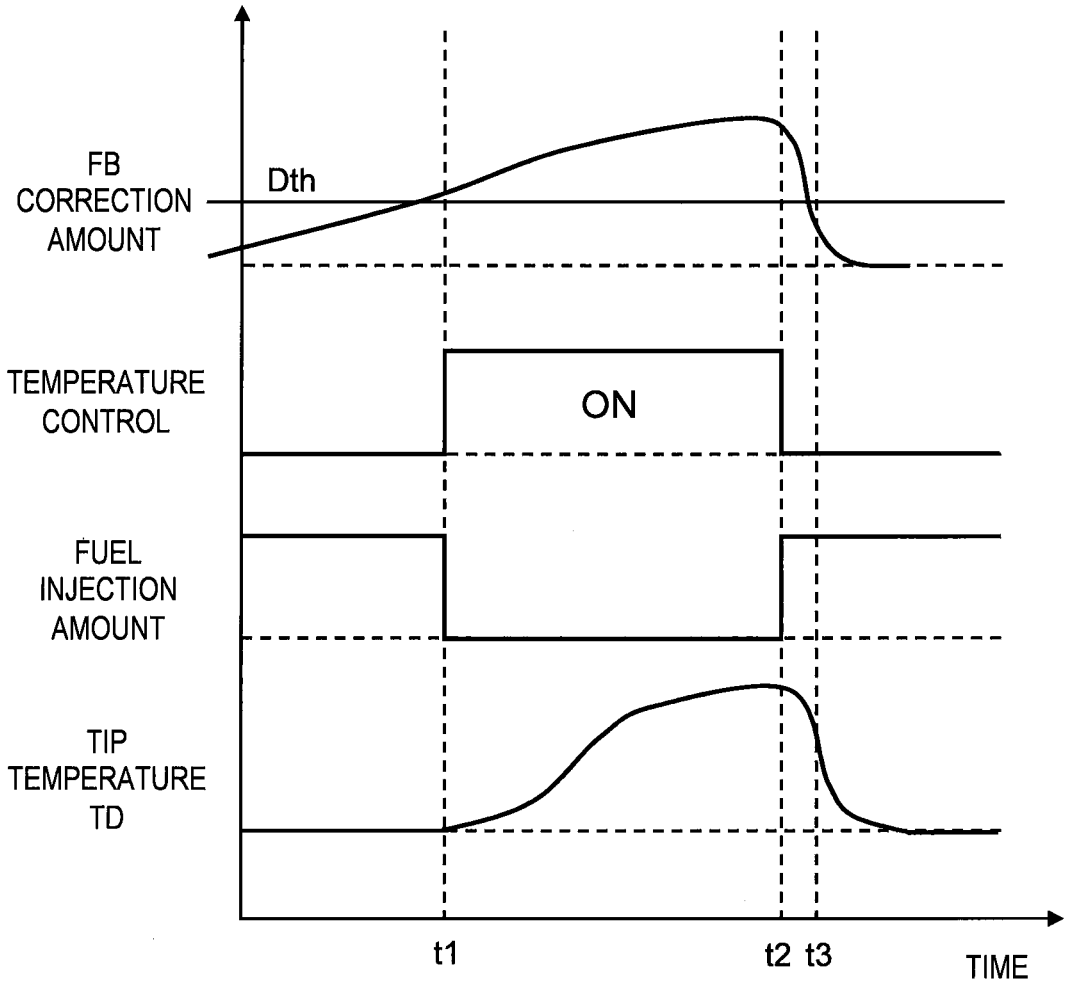
FIG. 8 is a timing chart showing an example of deposit removal processing in a second embodiment of the present invention.

FIG. 8 is a timing chart showing an example of the deposit removal processing in the present embodiment. The internal-combustion engine 1 is performing the light load operation and the feedback correction amount increases with time.

At a time t1, the feedback correction amount exceeds the allowable value Dth. The control device 100 presumes that the thermoplastic deposit is formed on the injection hole portion 61 (Step S120; Yes), and starts the temperature control processing (Step S130). More specifically, the control device 100 stops the fuel injection from the direct fuel injector 60. As a result, the temperature of the injection hole portion 61 (i.e. the tip temperature TD) begins to increase.

At a time t2, the control device 100 terminates the temperature control processing and starts the first removal processing (Step S140). More specifically, the control device 100 resumes the fuel injection from the direct fuel injector 60.

At a time t3, the feedback correction amount becomes equal to or less than the allowable value Dth (Step S140;

No). The control device 100 determines that the thermoplastic deposit is removed, and terminates the deposit removal processing.

According to the second embodiment, the same effects as in the case of the first embodiment can be obtained. Moreover, the deposit presumption processing based on the feedback correction amount is simpler than the deposit presumption processing based on the counter Z.

5. Third Embodiment

Figure 9:
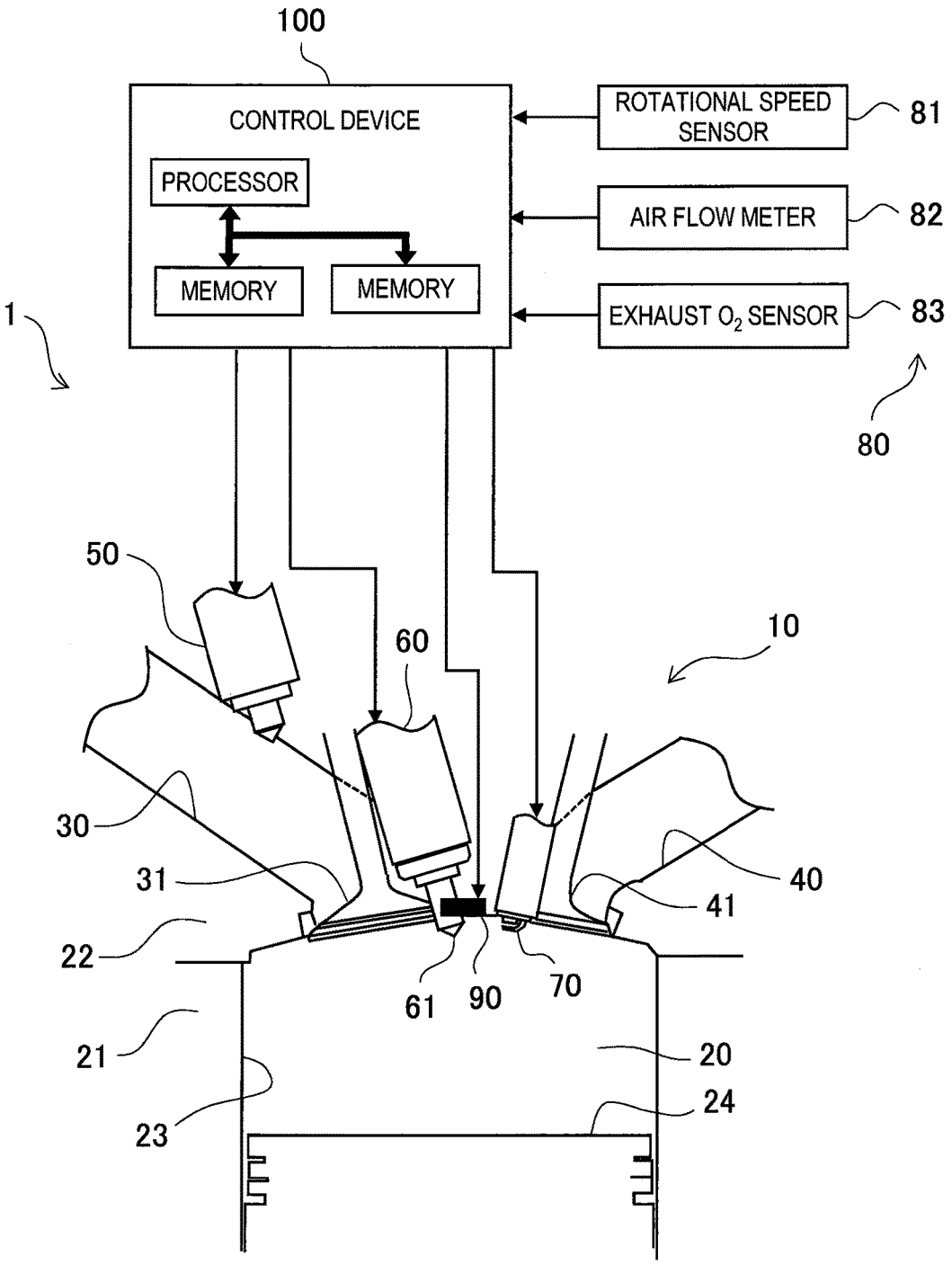
FIG. 9 is a schematic diagram showing a configuration example of an internal-combustion engine according to a third embodiment of the present invention.

FIG. 9 is a schematic diagram showing a configuration example of the internal-combustion engine 1 according to a third embodiment of the present invention. A heater 90 is further added as compared with the configuration shown in FIG. 1. The heater 90 is disposed to heat the injection hole portion 61 of the direct fuel injector 60. According to the present embodiment, the heater 90 is used in the temperature control processing.

Figure 10:
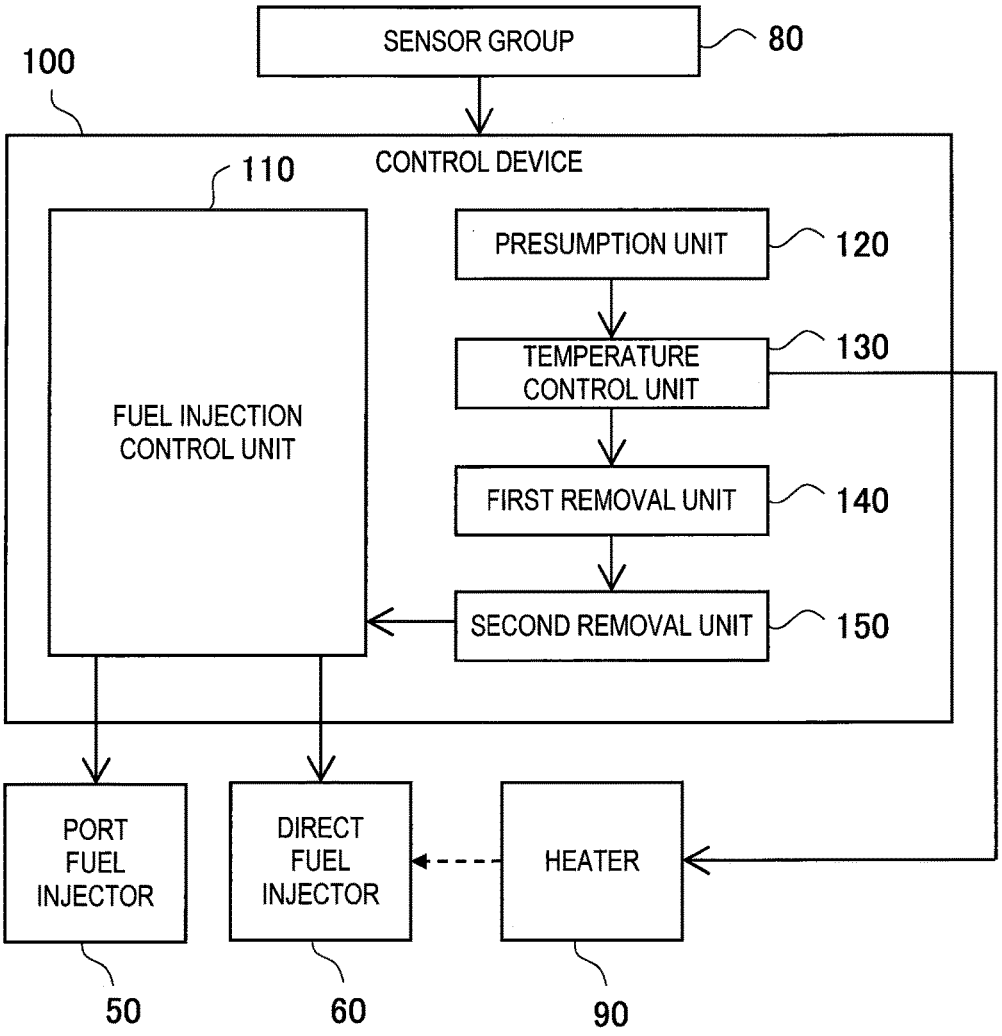
FIG. 10 is a block diagram showing a functional configuration of a control device according to the third embodiment.

FIG. 10 is a block diagram showing a functional configuration of the control device 100 according to the present embodiment. In the present embodiment, the temperature control processing by the temperature control unit 130 and the first removal processing by the first removal unit 140 are different from those in the foregoing embodiments. The deposit presumption processing by the presumption unit 120 and the second removal processing by the second removal unit 150 are the same as in the case of the foregoing embodiments.

Step S130: Temperature Control Processing

The temperature control unit 130 performs the temperature control processing that increases the temperature of the injection hole portion 61 of the direct fuel injector 60. More specifically, the temperature control unit 130 activates the heater 90. For example, the temperature control unit 130 turns ON the heater 90 for a certain period of time. The certain period of time is set to a length with which the target temperature (for example, 130 degrees centigrade) can be obtained. Alternatively, the temperature control unit 130 may monitor the tip temperature TD calculated from the temperature map mentioned above to control the operation of the heater 90 such that the tip temperature TD becomes the target temperature.

According to the present embodiment, there is no need to decrease the amount of fuel injection from the direct fuel injector 60 for the temperature control processing. Therefore, during the temperature control processing, the fuel injection control unit 110 performs the normal fuel injection control. The fact that there is no need to decrease the amount of fuel injection from the direct fuel injector 60 means that the port fuel injector 50 used for compensating for the decrease is not absolutely necessary. That is, the present embodiment can be applied also to the internal-combustion engine 1 that does not have the port fuel injector 50 but only the direct fuel injector 60.

Step S140: First Removal Processing

The amount of fuel injection from the direct fuel injector 60 has not decreased in the temperature control processing. Thus, it is not necessary in the first removal processing to restore the amount of fuel injection from the direct fuel injector 60. The fuel injection control unit 110 continues to perform the normal fuel injection control. The first removal unit 140 determines whether or not the thermoplastic deposit formed on the injection hole portion 61 is removed. The determination method is the same as in the cases of the foregoing embodiments.

Figure 11:
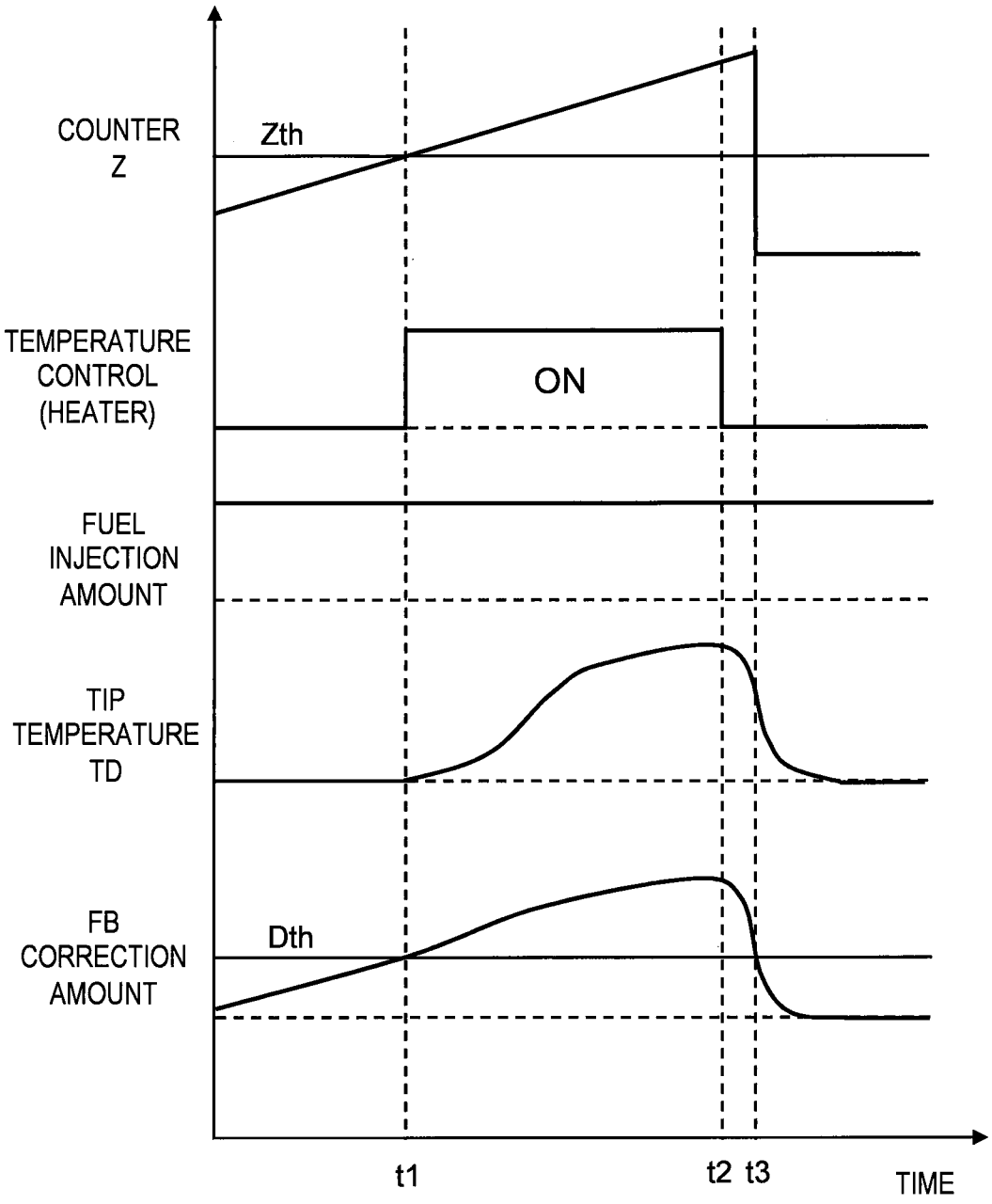
FIG. 11 is a timing chart showing an example of deposit removal processing in the third embodiment.

FIG. 11 is a timing chart showing an example of the deposit removal processing in the present embodiment. The internal-combustion engine 1 is performing the light load operation and the counter Z increases with time.

At a time t1, the counter Z exceeds the threshold value Zth (Step S126; Yes). The control device 100 presumes that the thermoplastic deposit is formed on the injection hole portion 61 (Step S120; Yes), and starts the temperature control processing (Step S130). More specifically, the control device 100 turns ON the heater 90. As a result, the temperature of the injection hole portion 61 (i.e. the tip temperature TD) begins to increase. It should be noted that there is no need to change the amount of fuel injection from the direct fuel injector 60.

At a time t2, the control device 100 turns OFF the heater 90. At a time t3, the feedback correction amount becomes equal to or less than the allowable value Dth (Step S140; No). The control device 100 determines that the thermoplastic deposit is removed, and terminates the deposit removal processing. At this time, the control device 100 initializes the counter Z.

It should be noted that in the present embodiment, the amount of fuel injection from the direct fuel injector 60 does not decrease in the temperature control processing, and thus there is a possibility that the thermoplastic deposit falls away during the temperature control processing. If the feedback correction amount becomes equal to or less than the allowable value Dth during the temperature control processing, the control device 100 may immediately turn OFF the heater 90.

According to the present embodiment, it is possible to soften the thermoplastic deposit by the heating. Therefore, it is possible to remove the thermoplastic deposit even at the low fuel pressure, as in the cases of the foregoing embodiments. Moreover, according to the present embodiment, there is no need to depart from the normal fuel injection control in the temperature control processing, and thus complicated control is not necessary. It should be noted that the present embodiment can be applied also to the internal-combustion engine 1 that does not have the port fuel injector 50 but only the direct fuel injector 60.

What is claimed is:

1. An internal-combustion engine comprising:

a direct fuel injector directly injecting fuel into a combustion chamber; and a control device, wherein the control device performs:

presumption processing that presumes, based on an operating condition of the internal-combustion engine, that a thermoplastic deposit is formed on an injection hole portion of the direct fuel injector;

temperature control processing that increases a temperature of the injection hole portion when the thermoplastic deposit is presumed to be formed; and first removal processing that injects the fuel from the direct fuel injector after the temperature control processing.

2. The internal-combustion engine according to claim 1, wherein during a normal operation of the internal-combustion engine, the control device performs normal fuel injection control to control fuel injection from the direct fuel injector, and wherein in the first removal processing, the control device performs the normal fuel injection control.

3. The internal-combustion engine according to claim 1, further comprising a port fuel injector injecting fuel into an intake port, wherein in the temperature control processing, the control device decreases an amount of fuel injection from the direct fuel injector while increases an amount of fuel injection from the port fuel injector.

4. The internal-combustion engine according to claim 3, wherein during a normal operation of the internal-combustion engine, the control device performs normal fuel injection control to control fuel injection from the direct fuel injector and the port fuel injector, wherein in the temperature control processing, the control device reduces the amount of fuel injection from the direct fuel injector below a value determined by the normal fuel injection control, and wherein in the first removal processing, the control device performs the normal fuel injection control.

5. The internal-combustion engine according to claim 1, further comprising a heater disposed to heat the injection hole portion, wherein in the temperature control processing, the control device activates the heater.

6. The internal-combustion engine according to claim 5, wherein during a normal operation of the internal-combustion engine, the control device performs normal fuel injection control to control fuel injection from the direct fuel injector, and wherein in the temperature control processing and the first removal processing, the control device performs the normal fuel injection control.

7. The internal-combustion engine according to claim 1, wherein the presumption processing includes:

processing of detecting a low temperature condition where the temperature of the injection hole portion is equal to or lower than a threshold value reflecting an upper limit of a formation temperature of the thermoplastic deposit; and processing of presuming that the thermoplastic deposit is formed on the injection hole portion, when the low temperature condition occurs at a certain level or more.

8. The internal-combustion engine according to claim 1, wherein during a normal operation of the internal-combustion engine, the control device performs normal fuel injection control to control fuel injection from the direct fuel injector, wherein the normal fuel injection control includes feedback control that corrects an amount of fuel injection based on a difference between a target air-fuel ratio and an actual air-fuel ratio, and wherein the presumption processing includes processing of presuming that the thermoplastic deposit is formed on the injection hole portion, when a correction amount of the amount of fuel injection in the feedback control exceeds an allowable value.

9. The internal-combustion engine according to claim 1, wherein the control device further performs second removal processing, when it is determined that the thermoplastic deposit is not removed by the first removal processing, and wherein in the second removal processing, the control device makes a fuel injection pressure of the direct fuel injector higher than in the first removal processing.

* * * * *